United States Patent [19]

Sutphin, Jr.

[11] 4,163,192

[45] Jul. 31, 1979

[54] IGNITION SPARK ZONE DURATION CIRCUIT

[75] Inventor: Eldon M. Sutphin, Jr., Merrimack, N.H.

[73] Assignee: RCA Corporation, New York, N.Y.

[21] Appl. No.: 890,704

[22] Filed: Mar. 27, 1978

[51] Int. Cl.[2] ..... F02P 17/00

[52] U.S. Cl. ..... 324/15; 307/268; 328/34; 324/181

[58] Field of Search ..... 324/15, 16 R, 181, 186; 73/117.3; 307/261, 264, 268, 273; 328/34, 164

[56] References Cited

U.S. PATENT DOCUMENTS

| | | | |
|---|---|---|---|
| 2,005,111 | 6/1935 | Shore | 328/164 X |
| 2,428,011 | 9/1947 | Chatterjea et al. | 328/164 |
| 3,053,996 | 9/1962 | Stefanov | 328/34 X |
| 3,416,080 | 12/1968 | Wright et al. | 324/186 |
| 3,551,800 | 12/1970 | Widmer | 324/15 |
| 3,566,283 | 2/1971 | Diebler | 307/261 X |
| 3,714,554 | 1/1973 | Benedix | 324/16 R |
| 3,970,872 | 7/1976 | Kuhn et al. | 324/15 UX |

*Primary Examiner*—Stanley T. Krawczewicz
*Attorney, Agent, or Firm*—Samuel Cohen; Carl V. Olson

[57] ABSTRACT

A circuit for generating a clean square electrical pulse having a duration equal to the spark zone duration in an internal combustion engine includes a comparator connected to produce an output when the signal input thereto, coupled from the primary winding of the ignition coil, exceeds a predetermined high voltage at the reference voltage input of the comparator. A one-shot multivibrator triggered by the initial output of the comparator generates an output continuing beyond the duration of high voltage ringing in the signal from the ignition coil. A "nor" gate receptive to outputs from the comparator and the one-shot produces an output which reduces the reference voltage applied to the comparator to a value below the plateau of the signal from the ignition coil. The "nor" gate provides the desired output spark zone duration pulse.

6 Claims, 3 Drawing Figures

IGNITION SPARK ZONE DURATION CIRCUIT

This invention relates to circuits useful in diagnostic equipment for internal combustion engines to determine the ignition spark zone duration in a cylinder of the engine.

The time duration of the electrical spark, during which the electrical energy stored in the spark coil is dissipated by a discharge through ionized gases across the gap of the spark plug, varies with the electrical impedance in the high voltage path. The spark zone duration is abnormally long when the gap of the spark plug is too small, and the duration is abnormally short when the gap is too large, or there is a high impedance or deficiency somewhere else in the high voltage circuit. Prior art means for testing spark zone duration has included means for displaying an ignition voltage waveform on the screen of an oscilloscope for visual observation and interpretation by a skilled test operator. It is clearly desirable to have diagnostic test equipment which provides spark zone information in a form which can be interpreted by a digital computer, so that the test equipment can be reliably operated by unskilled persons.

According to an example of the present invention, a voltage waveform which, may be obtained from the primary of the ignition coil of an engine, is applied to a comparator which turns on when the waveform initial peak exceeds a high voltage threshold, and which turns off when the waveform plateau falls below a low voltage threshold. The threshold voltage is varied by feedback means to produce a clean square output pulse despite high amplitude voltage oscillations at the beginning and the end of the spark zone.

Figure 1:
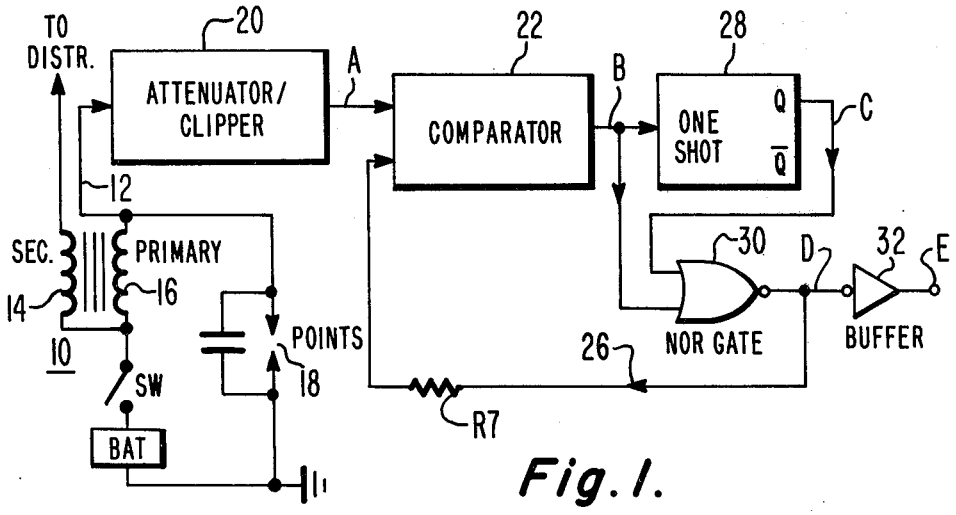
FIG. 1 is a block diagram of a system for generating a clean square pulse having a width equal to the ignition spark zone duration in an internal combustion engine.

In FIG. 1, the spark ignition system of an internal combustion engine is shown to include an ignition coil 10 having a secondary coil 14 which is connected to a distributor (not shown), and having a primary coil 16 which is connected from a terminal 12 through an ignition on-off switch SW and a battery BAT to a point of ground or reference potential. The terminal 12 is also connected through ignition points 18, or an electronic circuit equivalent, to ground.

Figure 3:
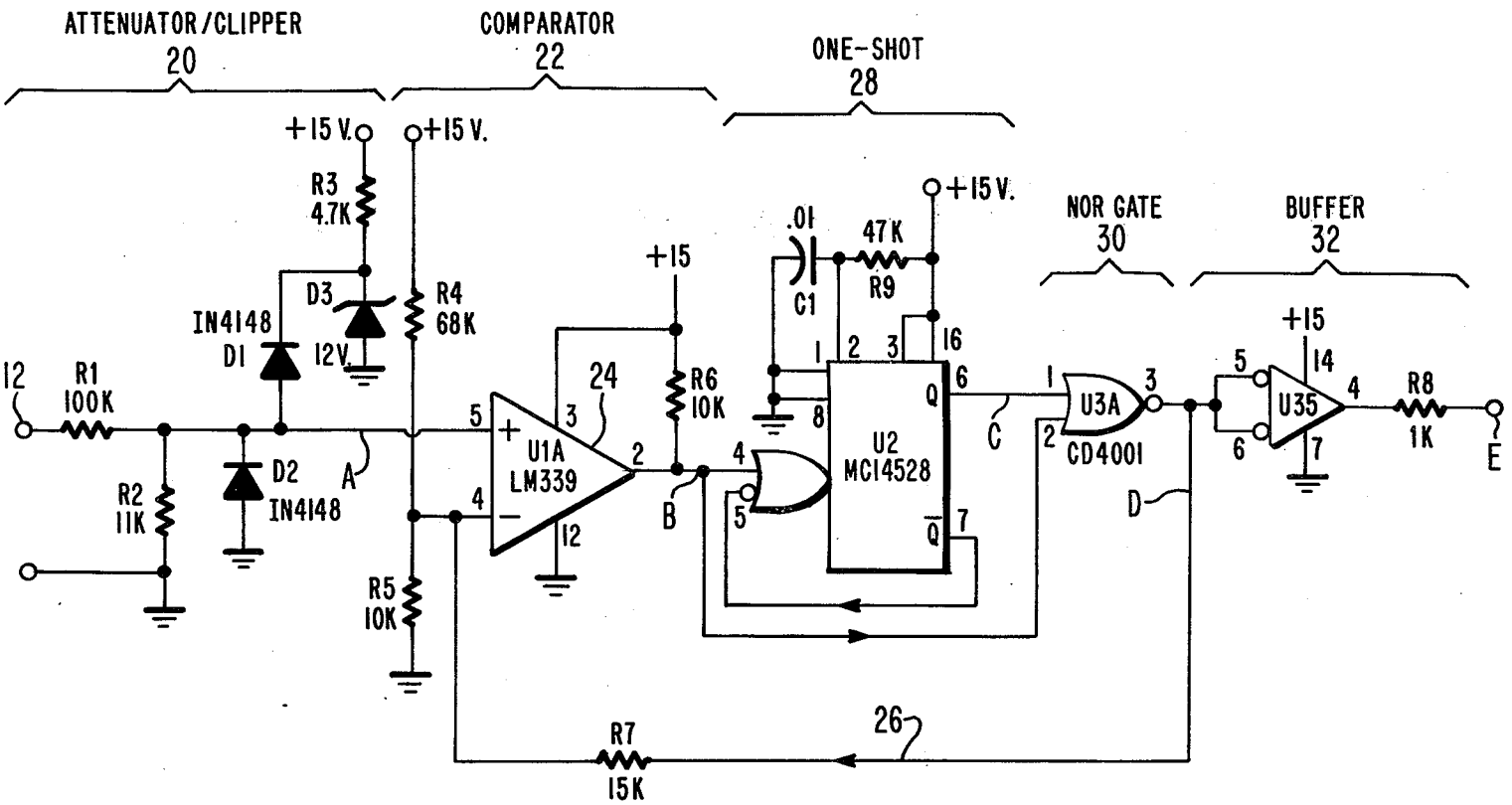
FIG. 3 is a detailed diagram of the circuits in the boxes of FIG. 1.

The voltage across the primary coil 16 (and the battery BAT.) is applied from the terminal 12 to the input of an attenuator/clipper 20, shown in detail in FIG. 3, in which the high voltage waveform from the ignition system is attenuated and clipped to lower values suitable for use in integrated circuit logic units. The output at A of circuit 20 is applied to the + input of a comparator 22 including a differential amplifier 24, as shown in FIG. 3, which also has a minus (−) input for receipt of a reference or threshold voltage. The reference voltage applied to the − input of amplifier 24 is determined by a voltage divider network of resistors R4 and R5, as modified by a signal applied over a feedback path 26 including a resistor R7, to the − input of the amplifier.

The output at B of the comparator 22 is applied to the trigger input of a one-shot monostable multivibrator 28, and also to an input of a "nor" gate 30, both shown in detail in FIG. 3. The output of the "nor" gate 30 at D is applied through the feedback path 26 to the reference voltage input of the comparator, and is applied through a buffer 32 to a signal output terminal E.

Figure 2:
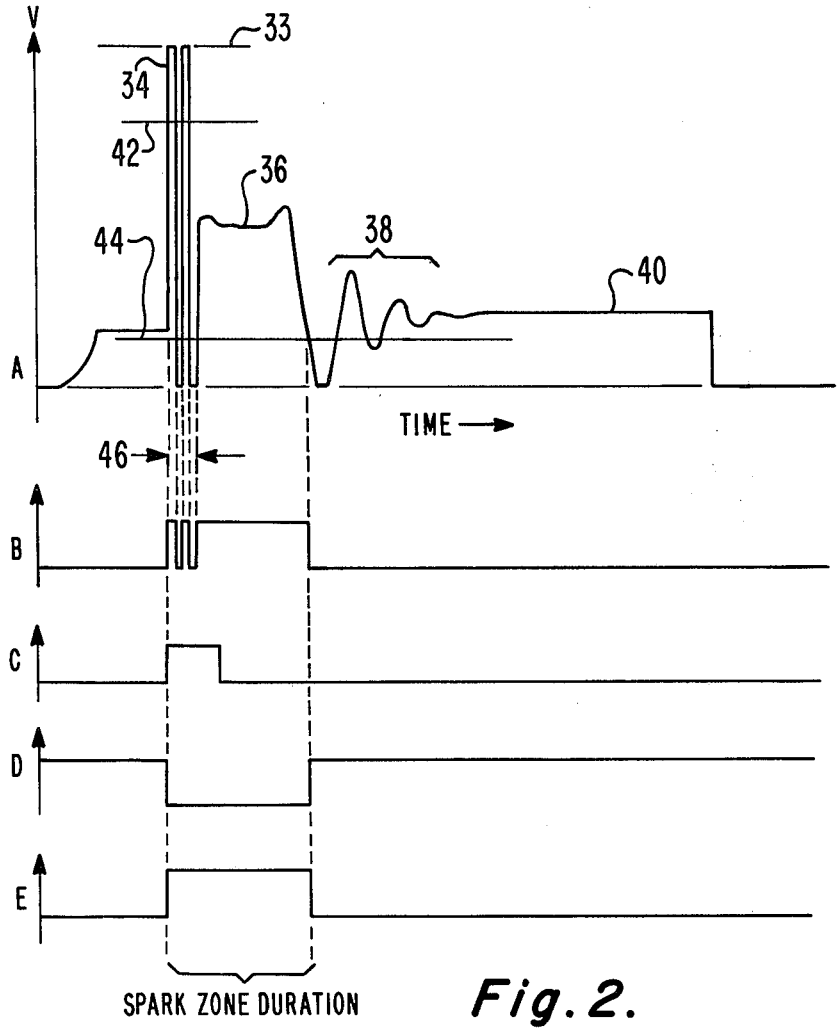
FIG. 2 is a chart of waveforms which will be referred to in describing the operation of the system of FIG. 1.

The operation of the system will now be described with references to the waveforms A through E of FIG. 2 which occur at correspondingly-identified points in FIGS. 1 and 3. The waveform A represents the waveform from the primary 16 of the ignition coil 10 after being attenuated and clipped in circuit 20, where negative excursions are prevented by diode D2 and positive excursions are clipped at a level 33 in FIG. 2 by the circuit of diodes D1 and D3 in FIG. 2, diode D3 being a zener diode. The ignition circuit waveform before clipping may have an initial peak 34 of 350 volts followed by high voltage ringing oscillations, which are in turn followed by a spark zone plateau 36 at about 40 volts. Ringing oscillations of 3kHz at 38 also follow the end of the spark zone plateau. A voltage approximately equal to the voltage of battery BAT continues at 40 until the ignition points 18 close.

Initially, the reference voltage applied to the reference input of comparator 22 is a high value 42, so that the comparator is turned on only after the initial input pulse at A exceeds this high value. The output B of the comparator 22 then fluctuates up and down during the period 46 in response to the high voltage oscillations following the initial peak 34. This is true even though the threshold voltage at the − input has been lowered to a value 44, as will be described.

The initial peak output in the waveform B from comparator 22 triggers the one-shot 28 to produce an output C for a time period long enough to exceed the time period 46 during which the high voltage oscillations occur. The output B from the comparator and the output C from the oneshot are applied to the "nor" gate 30 to produce an output D therefrom in which a negative pulse has a duration equal to the spark zone duration indicated by waveform A. The negative pulse is applied over the feedback path 26 to lower the threshold voltage at the − input of comparator 24 to a value such as 44 in FIG. 2A. The comparator turns off following the plateau 36 of the input waveform when the voltage falls below the threshold 44. Then the threshold supplied by "nor" gate 30 is raised to the value 42. As a result, the following input voltage oscillation (shown at 38 of waveform A), which exceeds the low threshold 44, does not exceed the high threshold 42, and the comparator remains off.

The negative pulse at the output D of "nor" gate 30 is translated to a positive pulse at the output E ofinverting buffer 32.

The pulse at E is a clean square spark zone duration pulse suitable for application to computercontrolled digital logic circuits for the purpose of computing the time duration of the pulse, evaluating the computed result, indicating a diagnostic conclusion, and instructing appropriate additional tests or repair procedures.

WHAT IS CLAIMED IS:

1. Means for generating a square electrical pulse having a duration equal to the spark zone duration in an internal combustion engine having an ignition coil, comprising a comparator connected to produce an output when the signal input thereto, coupled from the primary winding of the ignition coil, exceeds a predetermined high voltage at the reference voltage input of the comparator, triggered means responsive to the initial output of the comparator to generate an output continuing beyond the duration of high amplitude ringing in the signal from said ignition coil, feedback means operative during outputs from one or the other or both of the comparator and the triggered means to reduce the reference voltage applied to the comparator to a value below the plateau of the signal from the ignition coil, and means to derive an output pulse from the feedback means.

2. The combination according to claim 1 wherein said triggered means is a monostable multivibrator.

3. The combination according to claim 2 wherein said feedback means includes an "or" gate receptive to outputs of the comparator and the multivibrator, and said output pulse is derived from the output of "or" gate.

4. Means for generating an electrical pulse having a duration equal to the spark zone duration in an internal combustion engine, comprising a comparator having a signal input coupled to the primary winding of the ignition coil of the engine, and having a reference signal input, a monostable multivibrator having a trigger input coupled to the output of the comparator, and an "or" gate coupling the output of the comparator and the output of the multivibrator to the reference signal input of the comparator, whereby the output of said "or" gate is a clean square pulse having a duration equal to the spark zone duration.

5. In combination, a comparator having a signal input, a reference input, and an output, a monostable multivibrator having a trigger input coupled to the output of the comparator, and an "or" gate coupling the output of the comparator and the output of the multivibrator to the reference input of the comparator.

6. For use with an ignition coil, the combination of a comparator having two input terminals and an output terminal;

means for applying to one of the input terminals a control voltage at a reference level;

means for applying to the other of the input terminals a wave from the ignition coil;

triggered means responsive to a signal at the output terminal of the comparator and having an output, feedback means coupled to the comparator and to the triggered means and supplying feedback to said one input terminal of the comparator for modifying the threshold of the comparator, and means to derive an output from the feedback means.

* * * * *